US006571755B1

(12) United States Patent
Dunn et al.

(10) Patent No.: US 6,571,755 B1
(45) Date of Patent: Jun. 3, 2003

(54) TWO-STROKE ENGINE

(75) Inventors: Paul Francis Dunn, New Farm (AU); Robert Matthew Rutherford, Nundah (AU)

(73) Assignee: Rotec Design Ltd., Queensland (AU)

( * ) Notice: Subject to any disclaimer, the term of this patent is extended or adjusted under 35 U.S.C. 154(b) by 0 days.

(21) Appl. No.: 09/831,439

(22) PCT Filed: Nov. 9, 1999

(86) PCT No.: PCT/AU99/00988

§ 371 (c)(1),
(2), (4) Date: Aug. 16, 2001

(87) PCT Pub. No.: WO00/28199

PCT Pub. Date: May 18, 2000

(30) Foreign Application Priority Data

Nov. 9, 1998 (AU) ..... PP7003

(51) Int. Cl.[7] ..... F02B 33/22; F02B 69/06
(52) U.S. Cl. ..... 123/70 R; 123/21
(58) Field of Search ..... 123/70 R, 21, 123/70 V

(56) References Cited

U.S. PATENT DOCUMENTS

| | | | | |
|---|---|---|---|---|
| 1,134,684 A | * | 4/1915 | Kramer | 123/21 |
| 2,080,633 A | * | 5/1937 | Ray | 123/21 |
| 2,147,797 A | * | 2/1939 | Oldham | 123/70 V |
| 3,880,126 A | | 4/1975 | Thurston et al. | 123/70 |
| 6,286,467 B1 | * | 9/2001 | Ancheta | 123/21 |
| 6,340,004 B1 | * | 1/2002 | Patton | 123/25 C |

FOREIGN PATENT DOCUMENTS

| | | |
|---|---|---|
| AU | 1788/21 | 5/1921 |
| AU | 121622 | 6/1946 |
| FR | 2 724 691 | 3/1996 |
| FR | 96-181485/19 | 3/1996 |
| WO | WO 90/15917 | 12/1990 |
| WO | WO 92/01146 | 1/1992 |
| WO | WO 96/21804 | 7/1996 |

* cited by examiner

*Primary Examiner*—Willis R. Wolfe
(74) *Attorney, Agent, or Firm*—Fulbright & Jaworski LLP

(57) ABSTRACT

This invention provides a method of converting a four-stroke reciprocating piston engine into an efficient two-stroke engine breathing through the original overhead valves. This is achieved by providing a reciprocating positive displacement pump having respective pumping chambers arranged with their outlet adjacent the inlets of the engine and feeding a group of power cylinders. The pump is driven through a step-up drive from the engine and the timing is such that each pumping piston leads alternate ones of the power pistons in the group fed thereby to their respective Top Dead Center positions, the inlet valve to each power cylinder to be fed opens before Bottom Dead Center and closes before TDC, and the outlet valve from the fed power cylinder opens before BDC and closes before TDC.

16 Claims, 3 Drawing Sheets

TWO-STROKE ENGINE

This is a national stage application of PCT/AU/99/00988, filed Nov. 9, 1999.

This invention relates to engines.

This invention has particular application to methods of and apparatus for converting standard four-stroke engines into efficient two-stroke engines. However this invention is not limited to converting engines and may be applied to the original production of an efficient two-stroke engine.

There are prior disclosures of two-stroke engines which utilise power cylinders charged from a pumping chamber to provide increases in efficiency. However inherent in such proposals is the high cost of re-tooling for an all new engine design. Furthermore it is considered that many of these earlier proposals may not meet the stringent emission standards now required of most internal combustion engines. For example, it is very desirable to reduce emissions of oxides of nitrogen (NOx) and particulates including soot. Efficiency in terms of such emission reductions can be more important than fuel efficiency or achieving power gains.

The existing engine industry is large, mature, stable and conservative. The barriers to entry for even modest changes to engine design are formidable. Engine buyers are committed to existing engines and engine design. They are tooled up with expensive plant and equipment for conventional engines and are more likely to accept technological advances of an incremental nature, as opposed to radical departures.

This invention in one aspect aims to provide methods of and apparatus for converting standard four stroke engines into two-stroke engines which may operate efficiently in terms of selected or all exhaust emissions, fuel efficiency and power output from the converted engine. This invention also aims to provide engines which are useful and which have commercial appeal to both manufacturers and users.

With the foregoing in view this invention in one aspect resides broadly in a method of converting a four-stroke reciprocating piston engine into a Two-stroke engine including:

providing a reciprocating positive displacement pump having a respective pumping chamber for groups of at least two cylinders of the engine, each pumping chamber having a displacement swept by its pumping piston which is greater than the swept cylinder displacement of each cylinder of the engine;

securing the pump to a mounting on the engine adjacent the cylinders whereby the outlet from the pump is located closely adjacent the inlets of the engine;

arranging the crank pins for each group of cylinders at angular spacings of 360° divided by the number of cylinders in the group;

providing step-up drive means for driving the pump from the engine, the step-up being in the ratio of the number of cylinders in each group of cylinders of the engine per pumping chamber;

providing relatively short feed passages through transfer manifolding interconnecting the outlet from each pumping chamber to the inlets of the group of cylinders to be fed thereby, and timing the connection between the engine and the pump and the operation of the inlet and exhaust valves of the engine such that:

the or each pumping piston leads alternate ones of the power pistons fed thereby to their respective Top Dead Centre (TDC) positions;

the inlet valve to each power cylinder to be fed opens before Bottom Dead Centre (BDC) and closes before TDC, and the outlet valve from the fed power cylinder opens before BDC and closes before TDC.

Preferably:

the or each pumping piston leads alternate ones of the fed power pistons to Top Dead Centre (TDC) position by 80° to 160° of crankshaft rotation;

the inlet valve to the power cylinder to be fed opens in the range 50° to 0° before BDC;

the inlet valve to the power cylinder to be fed closes in the range 70° to 160° before TDC of crankshaft rotation;

the outlet valve from the fed power cylinder opens in the range 110° to 40° before BDC, and the outlet valve from the fed power cylinder closes in the range 100° to 180° before TDC of crankshaft rotation.

In the above ranges the timings closer to BDC would be more suitable for engines which operate at relatively low operating speeds and particularly large engines. High speed engines would advantageously operate at the other end of the range.

For a typical two litre automotive diesel engine converted or operating to this cycle and optimised to operate at a synchronous speed of 1500 RPM for driving, a 24 OV alternator for example, the typical timings would be:

the pumping piston leads the power piston to top dead centre by 120°;

the inlet valve to the power cylinder to be fed opens at 40° before bottom dead centre and closes at 110° before top dead centre;

the outlet valve from the fed power cylinder opens at 70° before bottom dead centre and closes at 140° before top dead centre.

For a typical two litre automotive diesel engine converted or operating to this cycle and optimised for high speed, typical timings would be:

the pumping piston leads the power piston to top dead centre by 135°;

the inlet valve to the power cylinder to be fed opens at 45° before bottom dead centre and closes at 115° before top dead centre;

the outlet valve from the fed power cylinder opens at 85° before bottom dead centre and closes at 155° before top dead centre.

Step-up ratios of two to one for the driveshaft relative to the crankshaft are preferred for high speed engines in order that effective transfer of air from pump to power cylinder may be achieved. Step-up ratios of more than two to one are preferably limited to relatively slow speed and medium speed engines.

Suitably the swept volume of the pumping chamber is less than 1.6 times greater than each respective power cylinder. For example in applications requiring modest power gain the pumping chamber swept volume may be up to 30% greater than the swept volume of each respective power cylinder. In applications for high power gains the swept volume of the pumping chamber may be up to 60% greater than the swept volume of each respective power cylinder.

Preferably for greater emission improvements the swept volume of the pumping chamber may be 60% greater than the swept volume of each respective power cylinder swept volume.

Furthermore the pump components are required to operate under much lower pressures and temperatures than the power components and this invention enables the components to be optimised by having the relatively robust components of the converted engine perform work with each revolution while utilising less robust components for pumping and thus providing advantages in reduction of power consumption and an associated reduction in friction loads.

Preferably the transfer manifold or pump head is provided with a discharge valve which may be driven but which is suitably a reed valve or like pressure sensitive valve which prevents back flow of gases from the transfer manifold to the pump cylinder during the scavenging-intake phase of the power cylinder. More preferably the discharge valve is located closely adjacent the outlet from the pumping chamber minimising the re-expansion volume and thus improving the volumetric efficiency of the pumping chamber.

The provision of the discharge valve may trap a charge of pressurised fresh gas downstream of the discharge valve such that at initial opening of the inlet valve and before closing of the exhaust valve a positive flow of fresh gas is injected from the inlet manifold to enhance scavenging of the exhaust gases. This provision can also be utilised to inhibit the back flow of spent gases from the power cylinder via the transfer port and transfer manifold into the pump cylinder.

The transfer manifold from the pump to the group of cylinders may include a single upstream branch connected to the pump and communicating with a plurality of downstream branches with the cylinders of the group. In such an application a single discharge valve. such as a reed valve, may be utilised in the upstream branch for simultaneous communication with all downstream branches.

However it is preferred that the discharge valve be of a type which may be controlled to communicate in a sequential manner with alternate ones of the downstream branches. This will minimise the effective volume of the passage between the pump and the respective cylinders for more efficient gas transfer. Preferably the discharge valve is a timed rotating drum valve which is disposed as close as possible to the pump piston crown at top dead centre and which provides sequential communication with the downstream branches.

Deflector means may be provided in the inlet tract or valve shrouding or the like may be provided to induce loop type scavenging of spent exhaust gases.

It is also preferred that a reed valve or other valve means be arranged in the inlet tract to the or each pumping chamber to assist in enhancing volumetric efficiency of the pumping chambers.

In order to provide the required crankshaft/driveshaft timing the group of cylinders being fed by the one pump cylinder must have their associated crank pins at angular spacings of 360° divided by the number of cylinders in the group. Accordingly the converted engine may require crankshaft modifications to achieve this configuration. The camshaft will require new 'timings' to suit. The camshafts will benefit from modified lift profiles to suit the shorter exhaust/inlet phase this may also require other valve train modifications, such as spring rates. Furthermore, the oil pump may be modified to accommodate a larger oil circuit to include the bolt on pump and to maintain pressure at a lower engine idle.

It is preferred that for balance purposes respective pairs of cranks, of converted engines having multiples of two cylinders, be evenly offset from one another. That is in a conventional four cylinder engine which has the cranks contained in a common plane, the front and rear pairs of cranks be offset at 90° to one another to producing a firing in the converted engine at every 90° of one revolution of the crankshaft.

In another aspect this invention resides broadly in a two stroke reciprocating engine having head mounted inlet and outlet valves and an external pump for charging the cylinders, wherein:

the external pump is a reciprocating positive displacement pump having a respective pumping chamber for groups of at least two cylinders of the engine, each pumping chamber having a displacement swept by its pumping piston which is greater than the swept cylinder displacement of each cylinder of the engine;

the pump is secured to a mounting on the engine adjacent the cylinders whereby the outlet from the pump is located closely adjacent the inlets of the engine;

the crank pins for each group of cylinders are arranged at angular spacings of 360° divided by the number of cylinders in the group.

step-up drive means is provided for driving the pump from the engine, the step-up being in the ratio of the number of cylinders in each group of cylinders of the engine per pumping chamber;

relatively short feed passages are provided through transfer manifolding interconnecting the outlet from each pumping chamber to the inlets of the group of cylinders to be fed thereby, and the connection between the engine and the pump and the operation of the inlet and exhaust valves of the engine are timed such that:

the or each pumping piston leads alternate ones of the power pistons fed thereby to their respective Top Dead Centre (TDC) positions;

the inlet valve to each power cylinder to be fed opens before Bottom Dead Centre (BDC) and closes before TDC, and the outlet valve from the fed power cylinder opens before BDC and closes before TDC.

In an engine with four or more cylinders, to prevent the exhaust pulse or phase of one cylinder from interfering with the scavenging phase of another cylinder, separate exhaust manifolds, or a manifold of a type which prevents interference of the exhaust phase with the scavenging phase, is provided. In the case of a turbocharged engine separate turbocharger inlets are provided or a dividing scroll is provided in the turbocharger inlet. Alternatively, separate turbochargers may be utilised.

In order that this invention may be more readily understood and put into practical effect, reference will now be made to the accompanying drawings which illustrates a typical embodiment of the present invention and wherein.

Figure 1:
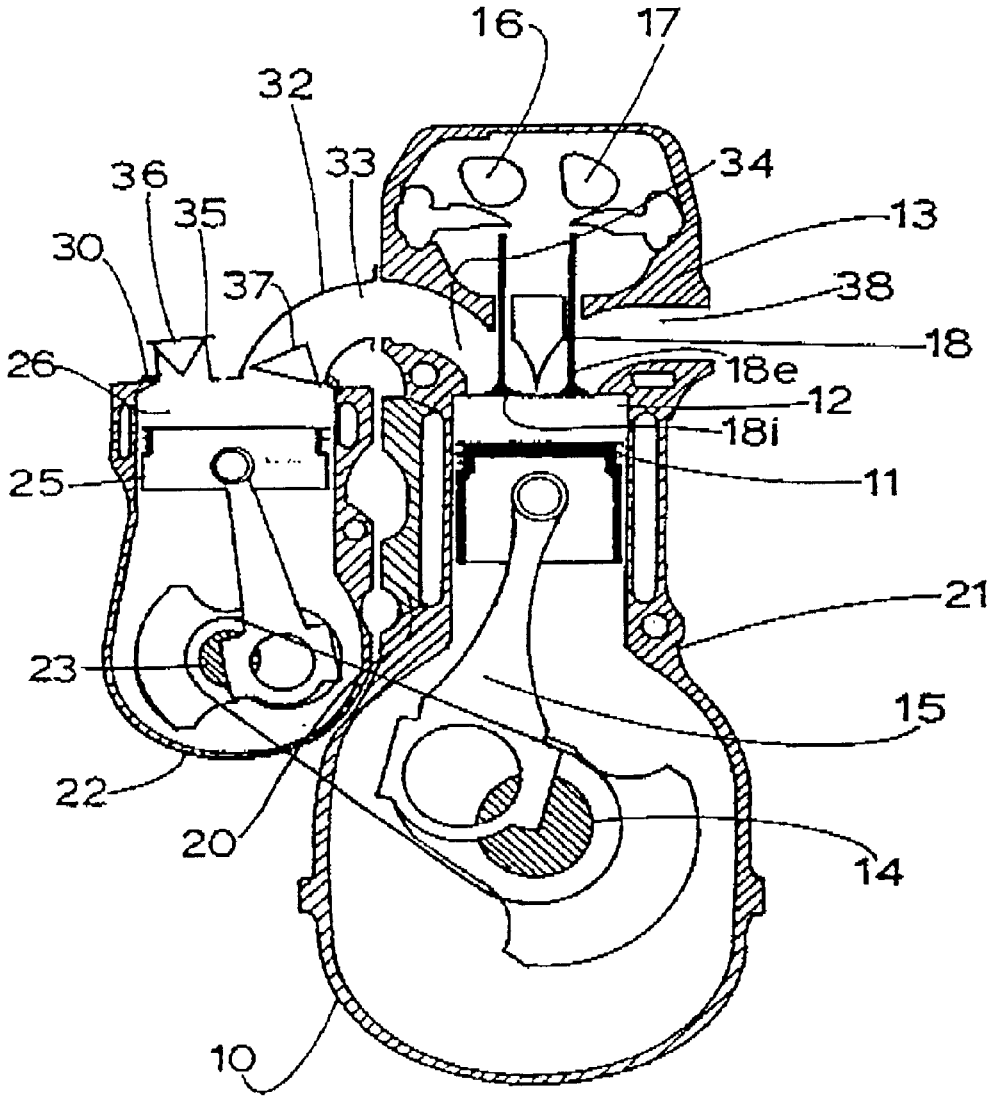
FIG. 1 is a diagrammatic end view of a conventional multi-cylinder four stroke engine adapted to operate as a two stroke by the apparatus of the present invention.

Referring initially to FIG. 1, it will be seen that a typical multi-cylinder four stroke engine 10 has pistons 11 arranged for reciprocation within cylinders 12 to and from a cylinder head assembly 13 which supports poppet valves 18 for control of fluid to and from the respective cylinders 12.

The pistons 11 are driven through a crankshaft 14 and are connected thereto by connecting rods 15. Overhead camshafts 16 and 17 are driven from the crankshaft in a timed relationship therewith whereby the poppet valves 18 control the four stroke process.

According to the present invention, such multi-cylinder four stroke engines are readily modified for operation as a two stroke engine by providing a mounting, and suitably in the form of an adaptor plate 20 at one side wall of the engine block 21 which is provided with threaded apertures to support a bolt-on reciprocating pump 22.

The pump 22 has a crank shaft 23 driven from the engine crankshaft 14 at twice the speed of rotation thereof whereby the piston 25 of the bolt-on pump reciprocates at twice the cycle speed of the pistons 11 of the engine 10. The bolt-on pump 22 provides one piston 25 and pumping chamber 26 for each two of the cylinders 12 of the engine 10 in which the pistons 11 reciprocate.

The bolt-on pump 22 is mounted with its cylinder head 30 mounted as close as practicable to the inlet openings through which the air inlet manifold normally connects so that relatively short transfer passages 32 may be arranged between the outlet port 33 from a respective pumping chamber to a pair of inlet ports, one of which is shown at 34 of the engine 10.

An inlet passage 35 is provided to the bolt-on pump 22 and non-return valves. suitably reed valves 36 and 37 are arranged in the inlet passage 35 and the transfer passage 32. Flow through the transfer passage is also controlled by the inlet poppet valve **18*i* and it will be seen that the inlet poppet valves 18*i* and the reed valves 37 are disposed near to the ends of the transfer passage 32. A further valve 18*e* is provided for each exhaust port 38 from the respective cylinder 12 in conventional manner, however the timing of the valves 18** is modified for two stroke operation.

Figure 3:
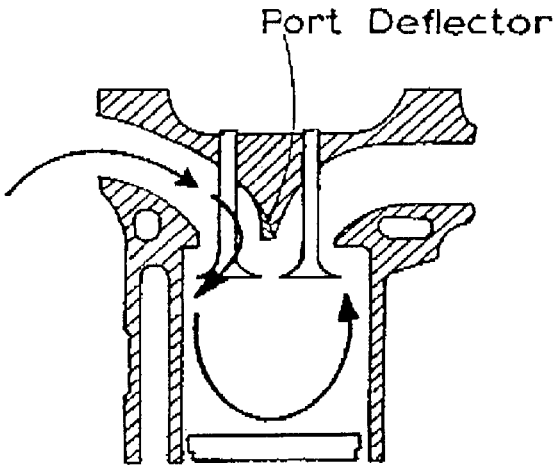
FIGS. 3 and 4 illustrate typical arrangements for port deflecting and valve shrouding.
Figure 4:
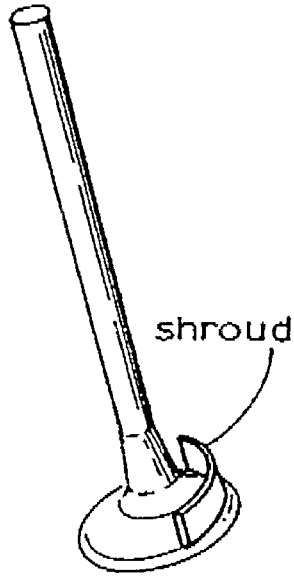

The inlet valve **18*i* or port 34 may require shrouding as shown in FIGS. 3 and 4** to direct the incoming air causing more efficient scavenging and reducing short circuiting and the cooling system may need a higher heat rejection rate, including higher flow rate water pump, and larger radiator. If desired, the original four stroke inlet port may need to become the exhaust port and vice versa.

The bore and stroke of the bolt-on pump provides a swept volume for each pumping chamber which is greater than the swept volume of each power cylinder 12 and for high power applications the swept volume of each pumping chamber may be 1.6 times the swept volume of each power cylinder 12.

The pumping chamber is timed relative to the power cylinder so that the respective pumping piston 25 reaches its top dead centre position in advance of the piston 11 in the power cylinder 12 into which a charge is being induced. In the illustrated embodiment, the pumping piston 25 reaches its top dead centre position while the power piston 11 is arranged at about 120° before its top dead centre position in the respective cylinder 12. The illustrated embodiment is a diesel engine which has injectors (not illustrated) which inject fuel directly into the combustion chamber.

In use, the bolt-on pump 22 is provided with a one way flow reed valve 36 in its inlet passage 35 such that during the downstroke of the piston 25 and continuing until beyond bottom dead centre, air is induced into the respective pumping chamber 26 above the piston 25 and then discharged therefrom through the one-way valve in the form of the reed valve 37 located at the entrance to the transfer passage 32. A rotary valve or a poppet valve could be used in lieu of a reed valve if desired.

The inlet valve **18*i* to the respective power cylinder 12 pens at about 40° before bottom dead centre of the pump 22 and closes during the upstroke of the piston 11 so that compression occurs during movement to top dead centre when fuel is injected and combustion occurs to provide a power stroke as the piston 11 moves down the cylinder 12** towards its bottom dead centre position.

The exhaust valve **18*e* then opens and exhaust gases are discharged therethrough as the piston continues beyond the bottom dead centre position and part way up the following compression stroke. Prior to closure of the exhaust valve 18*e*, the inlet valve 18*i* is opened and air trapped between the inlet valve 18*i* and the reed valve 37 in the transfer passage 32 and which is at a higher pressure than the residual exhaust gases at its time of opening so that the air trapped is forced into the cylinder 12** assisting with the scavenging of the exhaust gases.

Figure 5:
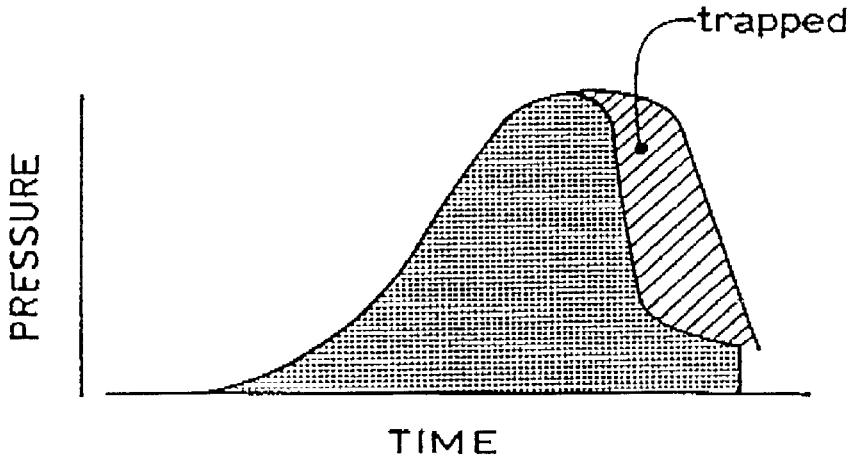
FIG. 5 is a graph of Pressure V Time for the transfer manifold.

This effect is illustrated in the graph of FIG. 5 wherein it will be seen that subsequent to the pump 22 raising the supply pressure, the reed valve 37 closes and traps pressurised air in the transfer manifold 32, demonstrated by the cross-hatched area.

The inlet valve **18*i* remains open so that the new charge induced into the pump 22** is forced into the combustion chamber for compression and repeat of the process described above.

Figure 2:
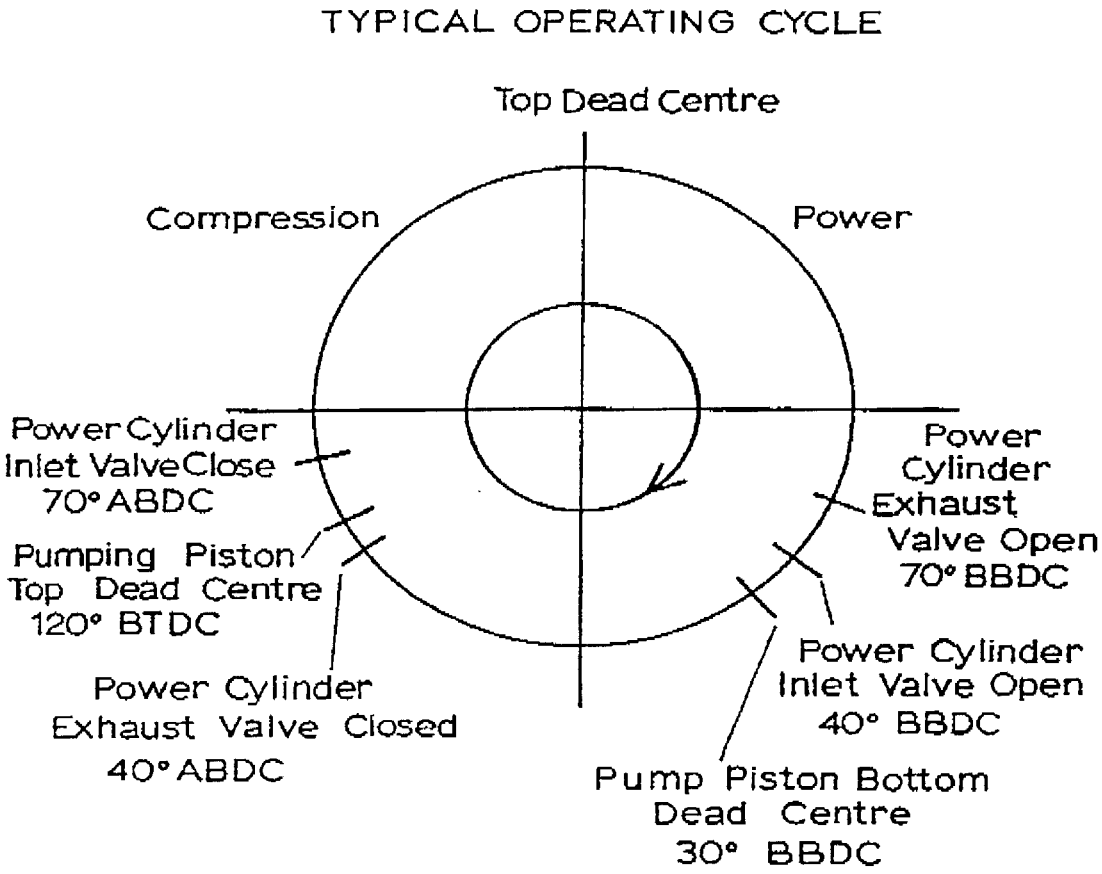
FIG. 2 illustrate the phases of the operating cycle.

In the embodiment illustrated in FIG. 1, the timing arrangements as illustrated in FIG. 2, are such that the pumping piston 25 reaches its top dead centre position when the respective power piston 11 is at 120° before top dead centre in the cylinder 12. The intake valve **18*i* is adapted to open at 40° prior to bottom dead centre of the piston 11 and close at 110° before top dead centre. The exhaust valve 18*e* is adapted to open at 70° prior to bottom dead centre of the piston 11 and close at 140° prior to top dead centre of the piston 11**. Diesel fuel is injected at 16°.

Furthermore the bolt-on pump has a swept capacity which is 1.4 times the swept capacity of each of the cylinders 12 of the engine 10.

This engine can be expected to operate efficiently as a two stroke engine producing up to 1.7 times the power of the original four stroke engine.

Preferably for a four cylinder engine, the bolt-on pump is a two cylinder pump having pistons 180° out of phase with one another and the crankshaft 14 of the conventional engine is modified by arranging the cranks of each group of two adjacent cylinders at 180° displacement from one another and with the two groups of cranks being displaced 90° from one another so as to provide a firing order of 1324.

By converting a conventional four stroke engine to a two stroke engine according to this invention the original torque and power output per unit of engine swept volume of the converted engine should be significantly increased. It is considered that torque and power output increases of up to 100% may be achieved for a converted four stroke engine.

Furthermore, power-to-weight and power-to-volume ratios are also enhanced and achieved with a weight penalty of 5%–10% of base engine weight, and being mostly the additional weight of the pump which performs a pumping function only and is not subject to combustion forces and thus may be relatively lightweight construction.

Thus it is expected that in a converted four stroke engine output gains of 70% may be achieved with a converted engine that is 30% lighter and 25% smaller in overall package volume than a comparable four stroke reciprocating combustion engine.

As each cylinder of the converted engine fires twice as often as the original the fuelling rate per combustion event may be reduced or the airfuel ratio is leaned. This should have the effect of lowering the peak cycle temperature and residence time at high temperatures. This lowers production of NOx and the greater oxygen availability reduces production of particulates and smoke.

Additionally, high levels of small and microscope turbulence will be present before and during the combustion event to assist in efficient combustion. This will result from the high rate of mass flow of the scavenging air past the inlet valve because the majority of incoming charge air is transferred in less than 90° of crank rotation and because of its late admission in the cycle which results from most air being transferred after bottom dead centre of the power piston. In this respect in a four stroke engine the small and microscope turbulence generated during induction mostly decays by the time combustion is initiated. In a converted engine according to this invention it is considered that the turbulence will be more intense than usual and created later in the engine cycle than usual resulting in substantial turbulence existing at combustion initiation.

This effect should manifest itself in significant reduction in spark advance or diesel injection advance requirement.

It is considered that the timing advance BTDC required for best torque in both petrol and diesel may be reduced from about 30° to 12° injection from about 30°–to 16°—respectively. In the diesel this may also significantly reduce the premixed phase of combustion and a consequent reduction in the rate of pressure rise and thus a reduction in production of NOx and noise.

It is also considered that because the scavenge air is delivered in a rapid pulse, as the pump piston is working at twice the cyclic rate of the engine pistons, increases in the mean velocity of the scavenge air will increase scavenging effectiveness. As the scavenge air is delivered relatively late in the cycle, the fresh charge short circuiting straight to exhaust will be minimised. Thus efficient scavenging should occur.

A converted engine of this invention will generally run lower cylinder pressures, but twice as many combustion events, and the individual pressure peaks will be lower and the individual torque pulses on the connecting rods and the crankshaft will be lower and more numerous, reducing torque fluctuation. Thus components such as crankshafts and bearings, connecting rods, cylinder head gaskets and piston ring groups which are designed to withstand normal four stroke loadings should have a similar or longer life expectancy.

It will be seen that this invention provides a bolt-on system for modifying engines which manufactures are set up to manufacture and which potentially provides substantial technical benefits while minimising the impacts on existing production technologies and facilities, staff retraining and R&D effort required for production. The conversion is suitably undertaken by existing engine manufacturers or at least partially during basic manufacture. However it can of course be performed by others.

The conversion utilises relatively low cost, well proven reciprocating piston componentry and is capable of being bolted on to production 4-stroke engines with a minimum of component and manufacturing plant and equipment changes. Thus should a manufacturer desire to enter a new larger kW market or assist in compliance with emission regulations, the manufacturer can provide a converted version of his existing engine according to this invention for that new market.

The manufacturer can utilise existing R&D knowledge, and need only make modest alterations to their production facility. In most cases the production facility will have sufficient capacity and flexibility to produce both the existing and converted engines of the present invention, so the production output break even point for both engines will be greatly reduced. Staff retraining is also minimised along with supplier sourcing problems.

In addition to supplying the pump and transfer manifold the manufacturer will be required to adapt a mounting and drive for the pump. The drive may be from the crankshaft at the front or the rear of the engine, or from any point along the engine crankshaft. The drive means may be of any type, requiring only that connection be suitably timed in operation. If desired the drive connection between the crankshaft and the driveshaft may be of a type in which the phasing is adjustable in use to suit the particular operating conditions. For example, at high load and high RPM, the phasing of the driveshaft may be advanced relative to the crankshaft such that the scavenging efficiency may be optimised.

The engine exhaust manifold may be modified to contain dividers or scrolls to separate the individual cylinder exhaust pulses however cylinders out of phase may share common exhaust manifold volume.

The exhaust ports may require additional cooling if they do not have sufficient heat rejection ability they may be insulated by ceramic port coatings.

Suitably the area of the engine for adaptation of the pump should contain provision for bolting or securing the pump thereto, such as studs or threaded holes or the like fixings. Preferably the area is a surfaced area or face for bolting and sealable ports are provided through which an internal drive is possible. The mounting area may also contain oil supply and return means and cooling water supply and return means.

The provision of a single pump cylinder feeding two power cylinders has the advantage that the pump piston is working at twice the cycle rate of the power pistons. This increases the mean velocity of the fresh charge being introduced into the power cylinder which is delivered late in the exhaust cycle thus minimising loss of fresh charge by short circuiting straight to the open exhaust valve.

The increased flow velocity may also have the beneficial effect of increasing turbulence of the incoming charge and at combustion initiation. It is further considered that this will enable stable idling speeds to be substantially reduced providing further economies.

It will of course be realised that the above has been given only by way of illustrative example of this invention and that all such and other modifications and variations thereto as would be apparent to persons skilled in the art are deemed to fall within the broad scope and ambit of this invention as is defined in the appended claims.

What is claimed is:

1. A two stroke reciprocating engine having head mounted inlet and exhaust valves and an external pump for charging the cylinders, wherein:

the external pump is a reciprocating positive displacement pump having a respective pumping chamber for groups of at least two cylinders of the engine, each pumping chamber having a displacement swept by its pumping piston which is greater than the swept cylinder displacement of each cylinder of the engine;

the pump is secured to a mounting on the engine adjacent the cylinders whereby the outlet from the pump is located closely adjacent the inlets of the engine;

the crank pins of the engine's crankshaft are arranged at angular spacings of 360° divided by the number of cylinders in the group;

the crank pins for each group of cylinders are arranged at angular spacings of 360° divided by the number of cylinders in the group;

step-up drive means is provided for driving the pump from the engine, the step-up being in the ratio of the number of cylinders in each group of cylinders of the engine per pumping chamber;

relatively short feed passages are provided through transfer manifolding interconnecting the outlet from each pumping chamber to the inlets of the group of cylinders to be fed thereby, and the connection between the engine and the pump and the operation of the inlet and exhaust valves of the engine are timed such that:

the or each pumping piston leads alternate ones of the power pistons fed thereby to their respective Top Dead Centre (TDC) positions;

the inlet valve to each power cylinder to be fed opens before Bottom Dead Centre (BDC) and closes before TDC, and the outlet valve from the fed power cylinder opens before BDC and closes before TDC.

2. A method of converting a four-stroke reciprocating piston engine into a two-stroke engine including:

providing a reciprocating positive displacement pump having a respective pumping chamber for groups of at least two cylinders of the engine, each pumping chamber having a displacement swept by its pumping piston which is greater than the swept cylinder displacement of each cylinder of the engine;

securing the pump to a mounting on the engine adjacent the cylinders whereby the outlet from the pump is located closely adjacent the inlets of the engine;

arranging the crank pins for each group of cylinders at angular spacings of 360° divided by the number of cylinders in the group;

providing step-up drive means for driving the pump from the engine, the step-up being in the ratio of the number of cylinders in each group of cylinders of the engine per pumping chamber;

providing relatively short feed passages through transfer manifolding interconnecting the outlet from each pumping chamber to the inlets of the group of cylinders to be fed thereby, and timing the connection between the engine and the pump and the operation of the inlet and exhaust valves of the engine such that:

the or each pumping piston leads alternate ones of the power pistons fed thereby to their respective Top Dead Centre (TDC) positions;

the inlet valve to each power cylinder to be fed opens before Bottom Dead Centre (BDC) and closes before TDC, and the outlet valve from the fed power cylinder opens before BDC and closes before TDC.

3. A method as claimed in claim 2, wherein the swept volume of the pumping chamber is less than 1.6 times greater than each cylinder of the engine.

4. A method as claimed in claim 2, wherein the swept volume of the pumping chamber is in the range of from 1.3 to 1.6 times greater than each cylinder of the engine.

5. A method as claimed in claim 2, including deflector means in the inlet tract for inducing loop type scavenging of spent exhaust gases.

6. A method as claimed in claim 2, providing a shrouded valve means in the inlet tract to each cylinder for inducing a loop type scavenging of spent exhaust gases.

7. A method as claimed in claim 2, including valve means in the inlet tract to each pumping chamber.

8. A method as claimed in claim 2, wherein the transfer manifold or pump head is provided with a discharge valve which prevents backflow of gasses from the transfer manifold to the pump chamber during the scavenging-intake phase of the power cylinder.

9. A method as claimed in claim 8, wherein the discharge valve is located closely adjacent the outlet from the pumping chamber.

10. A method as claimed in claim 2, wherein the transfer manifold includes a respective single upstream branch connected to a pumping chamber and a plurality of downstream branches communicating the cylinders in a group.

11. A method as claimed in claim 10 and including discharge valve in the upstream branch.

12. A method as claimed in claim 11, wherein the discharge valve is controlled to communicate sequentially with the downstream branches.

13. A method a s claimed in claim 2, wherein:

the or each pumping piston leads alternate ones of the power pistons fed thereby to Top Dead Centre (TDC) position by 80° to 160° of crankshaft rotation;

the inlet valve of each power cylinder opens in the range 50° to 0° before BDC;

the inlet valve to each power cylinder closes in the range 70° to 160° before TDC;

the outlet valve from each power cylinder opens in the range 110° to 40° before BDC, and the outlet valve from each power cylinder closes in the range 100° to 180° before TDC.

14. A method as claimed in claim 13 for an engine which operates at relatively low operating speeds, and operating in claimed range part proximate BDC.

15. A method as claimed in claim 13 for an engine which operates at relatively high operating speeds and operating in the claimed range part more distant from BDC.

16. A method as claimed in claim 15, wherein the step-up ratio is two to one.

* * * * *

UNITED STATES PATENT AND TRADEMARK OFFICE

CERTIFICATE OF CORRECTION

PATENT NO. : 6,571,755 B1 
DATED : June 3, 2003
INVENTOR(S) : Paul Francis Dunn and Robert Matthew Rutherford It is certified that error appears in the above-identified patent and that said Letters Patent is hereby corrected as shown below:

Column 10,
Line 15, please delete “gasses” and insert -- gases -- therefor.
Line 30, please delete “a s” and insert -- as -- therefor.

Signed and Sealed this

Twelfth Day of August, 2003

JAMES E. ROGAN
*Director of the United States Patent and Trademark Office*